United States Patent [19]

Lenzi

[11] Patent Number: 4,838,848

[45] Date of Patent: Jun. 13, 1989

[54] CONTINUOUS PAPER BAND FOLDING APPARATUS TO FORM PILES

[76] Inventor: Mauro Lenzi, Via G. Paganino 2 I 56100, Pisa

[21] Appl. No.: 113,281

[22] PCT Filed: Feb. 18, 1987

[86] PCT No.: PCT/IT87/00016

§ 371 Date: Oct. 6, 1987

§ 102(e) Date: Oct. 6, 1987

[87] PCT Pub. No.: WO87/04998

PCT Pub. Date: Aug. 27, 1987

[30] Foreign Application Priority Data

Feb. 19, 1986 [IT] Italy ..... 47671 A/86

[51] Int. Cl.[4] ..... B65H 45/20

[52] U.S. Cl. ..... 493/414; 493/413; 270/39

[58] Field of Search ..... 493/413, 416, 442, 451, 493/454, 411, 412, 414, 415; 414/69, 907; 270/31, 39, 40, 41

[56] References Cited

U.S. PATENT DOCUMENTS 3,770,264 11/1973 Sturman et al. ..... 270/79
4,172,592 10/1979 Müeller et al. ..... 270/61
4,650,447 5/1987 Meschi ..... 493/11

FOREIGN PATENT DOCUMENTS 2712588 9/1978 Fed. Rep. of Germany .

*Primary Examiner*—Frederick R. Schmidt
*Assistant Examiner*—Jack W. Lavinder
*Attorney, Agent, or Firm*—DeLio & Associates

[57] ABSTRACT

A continuous paper band folding apparatus to form paper sheet piles is disclosed, which apparatus allows the formed folds to be squeezed and the paper band to be exactly cut in order to achieve separate piles of paper sheets. The apparatus comprises two rotating shafts carrying blades which engage the paper band and provide to form a fold therein by the particular radial and longitudinal arrangement of the blades forming a cusp symmetric with respect to the point of engagement with the paper band. Blades are rotated synchronously with the feed of paper band so that initially a natural loop is allowed to be formed in the paper band when the blades do not interfere therewith. Then the vertex of the cusp formed by the blades engages the paper band, thus causing it to be folded back. Afterwards, due to the radially offset arrangement of the blades along the shaft, the folding back of the paper band carries on progressively on either side of the central cusp, thus avoiding the undesired crumpling of the paper sheets. The apparatus is also provided with a retractable device which is synchronized with the rotation of the blade carrier shaft and guides the paper band to keep on the natural fold.

7 Claims, 4 Drawing Sheets

CONTINUOUS PAPER BAND FOLDING APPARATUS TO FORM PILES

The present invention relates to a continuous paper band folding apparatus to form piles.

The larger and larger use of fast printers brings under specific applications to supply such printers directly from reels of paper preworked or not. In case of using non-preworked paper reels, the feeding machines provide for the machining of paper, i.e. punching of "feed holes" and "cross perforations". Such machining is needed for the following purposes:

Feed holes allow paper band to be fed by means of the socalled tractor feed, i.e. by means of teeth entering the feed holes and allowing a precise and fast positioning of the band without slippage.

Cross perforations of the band are predetermined lines of weakening of the paper so that tearing and folding are made easier. In practice such lines define the "pages" of a continuous paper band.

In both cases of feeding from either "virgin" or preworked paper reel the paper coming out of the printer either is torn sheet by sheet and stacked in piles or folded back like an "accordion". In the latter case which is the most usual for intuitive reasons of practicality, the most rational way to collect paper is to automatically form piles separated from one another for each printing job. Industries propose to solve this problem by first folding the paper fed from reels and not from piles preformed in printing houses and then by carrying it away from the folding head in so called "scales".

The paper folded back along cross perforation lines is put in scales on a belt conveyor performing the task to carry it away from the folding head. Operators are provided at intervals to cut the paper band and to collect it in piles manually. This is needed as the folding back of the paper is carried out by means of spirally twisted screws placed near each edge of the folded sheet. Such screws have the advantage of correctly operating as "folding units" both at low and high speed, but do not allow the folds thus formed to be "squeezed" along the whole extension thereof. Moreover paper has to come out of the folding head continuously so that considerable variations of the delivery scopo of sheets already folded by the "screws" are avoided, thus achieving generally the so called "scales".

The present invention seeks to provide a continuous paper band folding apparatus which is free from the troubles of the presently available apparatus.

The present invention, which is the result of an accurate research, satisfactorily works both as for the precision needed for the first folding of the paper and as for the squeezing of the effected fold which is needed to allow the pile to be formed directly by the folding head.

The apparatus according to the invention is provided with means, parts and members already known and used in the present folding heads as well as means, parts and members of novel design and use. Among the former there are the moving paper carrier plate, on which the continuous paper band from a reel is folded back by gravity like an "accordion"; the so called "tractor feed'-',i.e. a feeding system supplying paper to the moving plate and using feed holes evenly spaced apart and formed on both edges of the paper band, said system being provided with outer teeth entering the side holes to feed the paper band like a cinematographic film; and side cages retaining the paper pile and defining the dimension thereof, i.e. the longitudinal dimension of the single sheets and the interval between two folds in succession as well.

Among the latter there are the folding and squeezing means and a moving retractable device guiding and promoting the folds to be formed in the paper band which is laid down on the moving plate, as better disclosed herebelow.

The apparatus of this invention will be illustrated more in detail with reference to the accompanying drawing, in which.

Figure 1:
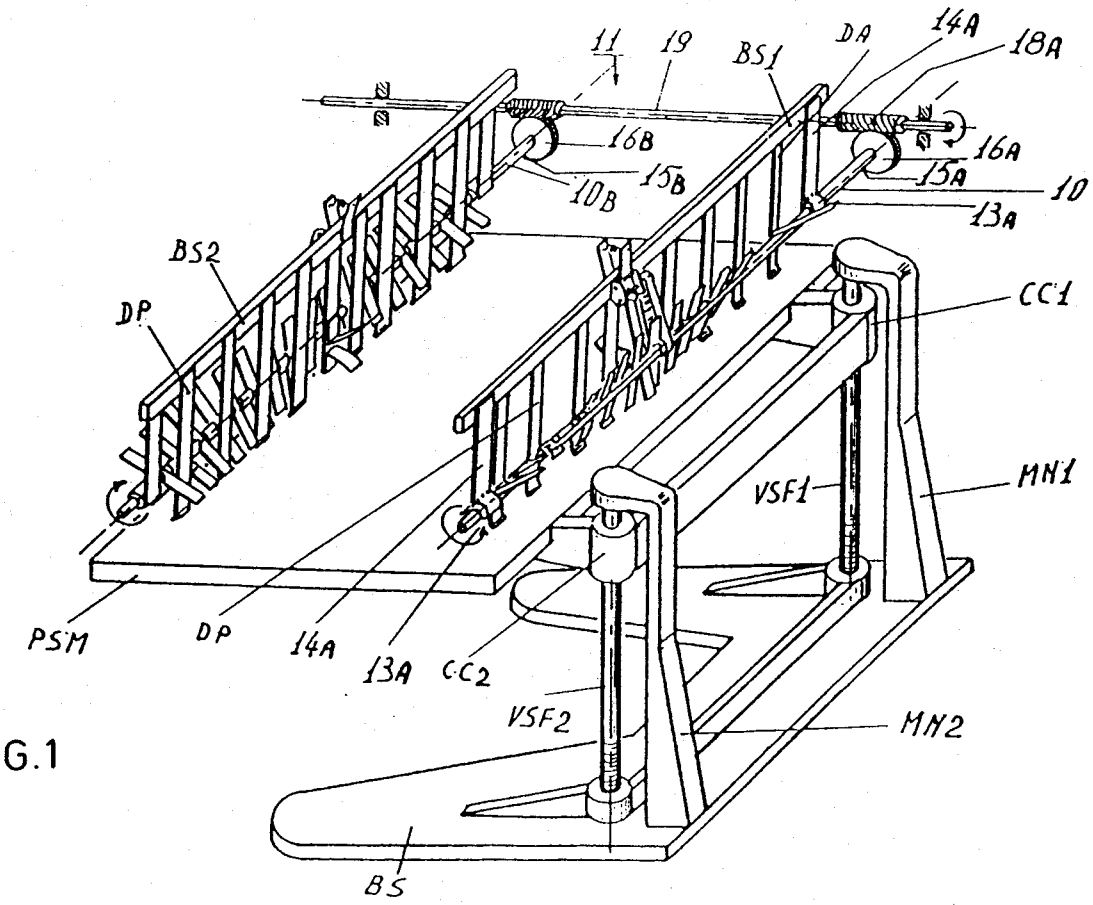
FIG. 1 is a perspective schematic view of a continuous paper band folding head provided with the apparatus according to the invention.
Figure 2:
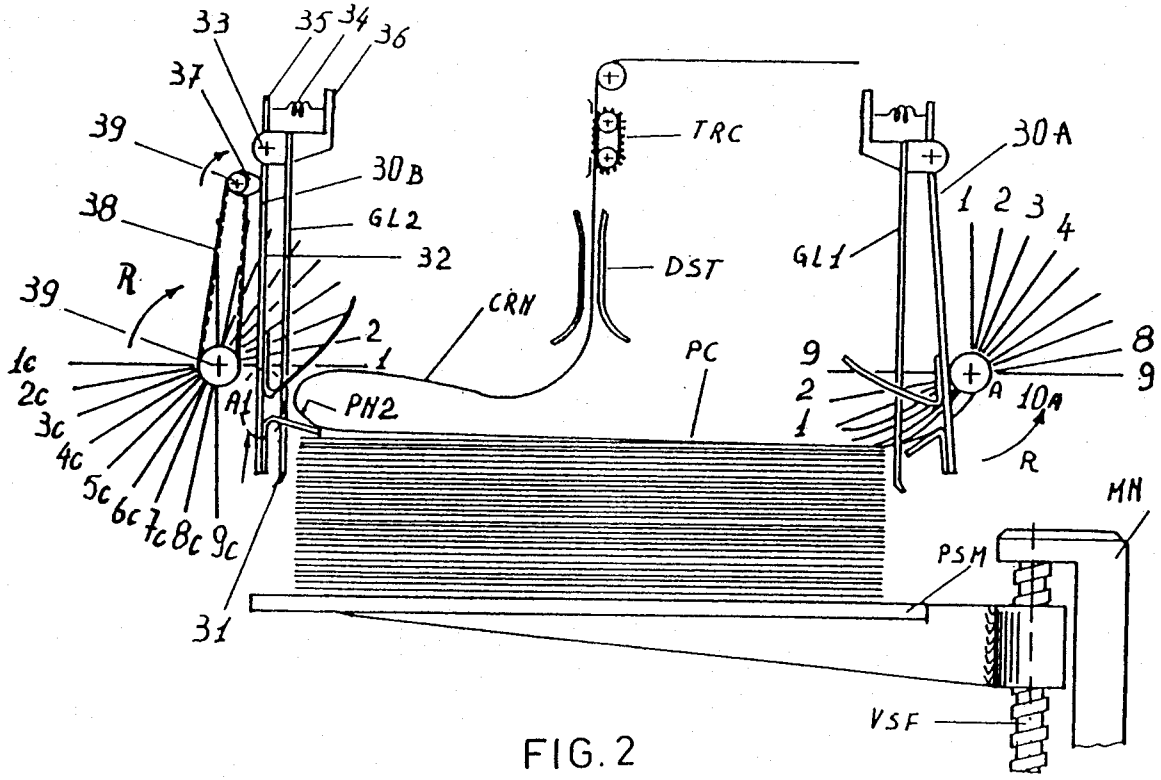
FIG. 2 is a rather schematic end elevation of the folding head of FIG. 1.
Figure 5:
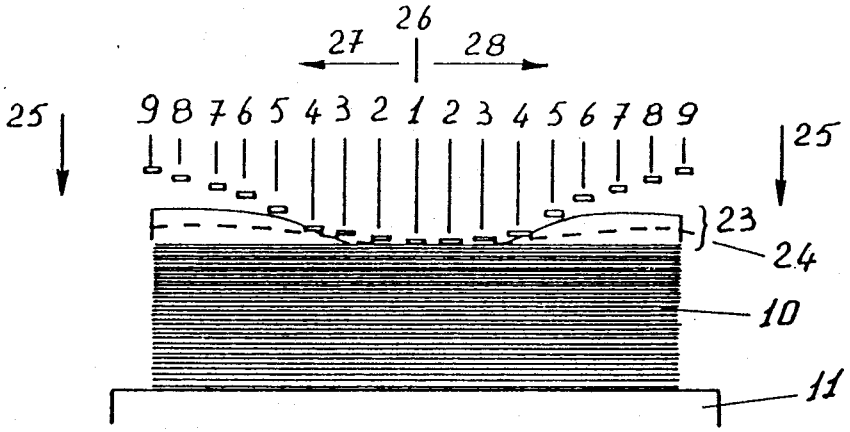

FIG. 5 is an elevation rotated by 90° with respect to FIG. 2 and schematically showing the sharp folding of the paper band starting from the central squeezing point and progressively and simmetrically extending to the right-hand and lefthand side of the latter, with the result of a paper squeezing to the edges of the pile. Referring now to FIGS. 1 and 2 a folding head essentially of the known type provided with the apparatus according to the invention is shown.

Such folding head is essentially provided, as known members, with a vertically moving support plate designated by PSM and supported in turn by two arms BB1 and BB2 integral with lead nuts CC1 and CC2, respectively, engaged on respective worm screws VSF1 and VSF2 which are supported by uprights MN1, MN2 and base plate BS. Worm screws VSF1 and VSF2 are rotated by motor means in both directions so as either to hoist or to lower the moving support plate PSM.

Tractor feed herein designated by TRC is known as a chain track means provided with projecting teeth engaging the side feed holes of continuous paper band which is unrolled from the storing reel (not shown) to plate PSM. Another known member is "distributor" DST schematically shown in the figure and moving alternately in the plane of FIG. 2. Distributor DST supplies continuous paper band N to plate PSM so that soft foldings are formed near the two side cages GL1 and GL2 formed of known members of a folding head.

As better shown in FIG. 1 side cages GL1 and GL2 consist each of an upper rod BS1, BS2, respectively, from which teeth designated by DP and spaced apart like a comb project downwards.

The folding apparatus according to the invention is designed to be applied to the known, just described folding head, said apparatus essentially comprising: two parallel rotating shafts designated by 10A and 10B and provided each with a number of blades; a drive means 11 to rotate both shafts under control of motor means (not shown); and two moving devices guiding and promoting the natural folding CRN (FIG. 2) of the paper band at both cages GL1 and GL2, such devices being generally designated by the references 30A and 30B, respectively.

Blade carrier shaft 10A is mounted so as to rotate over side cage GL1 on bushes 13A carried by support means 14A integral with upper rod BS1. Blade shaft 10A carries further at its end 15A a gear wheel 16A engaging a worm screw 18A carried by rotating shaft 19.

It should be understood that gear wheel 16A, worm screw 18A and shaft 19 along with the like members relative to blade shaft 10B, i.e. gear wheel 16B and worm screw 18B, form the above mentioned drive means 11.

Figure 3:
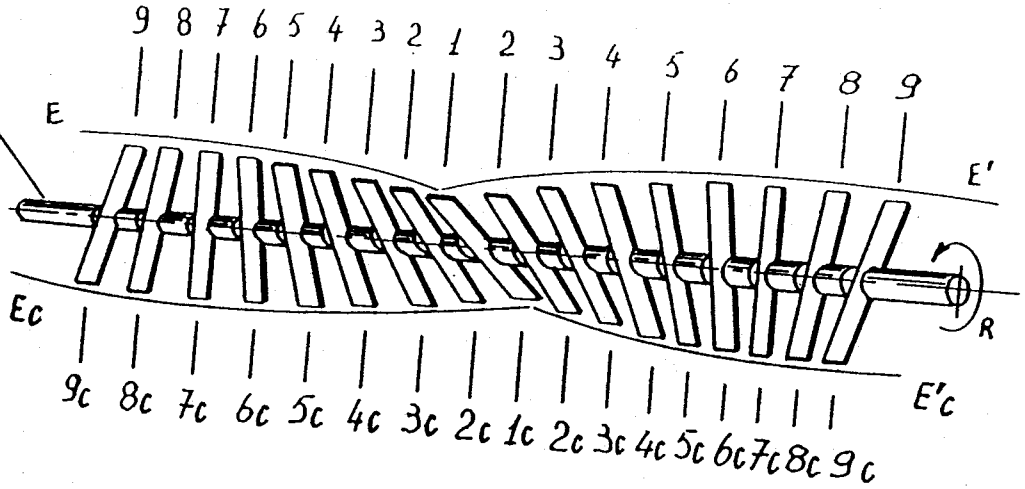
FIG. 3 is a perspective view in enlarged scale showing a blade carrier shaft and the arrangement of the single blades.
Figure 4:
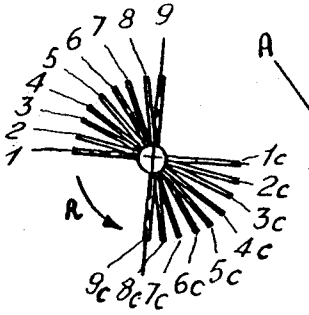
FIG. 4 is an end view of the blade carrier shaft of FIG. 3.

Reference is made now to FIGS. 3 and 4 in which one of the two blade carrier shafts is shown, which will be described with reference to shaft 10A, i.e. the right-hand shaft in FIGS. 1 and 2. It should be understood that said description is also valid for left-hand shaft 10B.

As shown blade carrier shaft 10A consists of an axis carrying a number of radially oriented and axially spaced blades. Such blades, in a number of seventeen in the illustrated embodiment, are designated the central blade by 1 and the other blades two by two by 2 to 9. The blades lie each in a radial plane which is offset by an angle with respect both to the radial plane containing the following blade and to the radial plane containing the preceding blade.

The pairs of radial blades symmetrically placed on either sides with respect to the central blade 1, i.e. the pairs of blades 2, 3 and so on, lie in the same radial plane.

Furthermore the set of seventeen blades 1 to 9 are diametrally opposed to another set of blades designated by the references 1*c* to 9*c*, each of them being the extension of the respective blade 1 to 9. Both sets of blades 1 to 9 and 1*c* to 9*c* have the same length and form two cylindrical spirals designated by E, E' and Ec, E'c, respectively.

The two cylindrical spirals E and E' form at the contact point a cusp corresponding to blade 1 and in the same way cylindrical spirals Ec, E'c form at the contact point a cusp corresponding to blade 1*c* The numerals designating both sets of blades indicate the position and the phase thereof with respect to the form of the folded band and to the direction of rotation of the shaft indicated by the arrow R. That is, if the set of blades 1 to 9 is that set carrying out the fold and the first compression, blades 1*c* to 9*c* is that set carrying out the squeezing of the fold formed by the former set of blades. It should be noted that both sets of blades can have a differential resistance to bending stress in order to optimize the operation considering their different functions. It is self evident that, due to the phase difference of the blades, when blade carrier shaft 10A is rotated in the direction of arrow R with respect to the horizontal plane of the rotation axis, blade 1 will come first into contact with the paper band and then the pair of blades 2, the pair of blades 3 and so on up to the pair of blades 9 will engage the paper band. This will cause the paper sheet in the plane at the top of pile PC to be squeezed progressively from blade 1 to the pair of extreme blades 9 with the result of a "stretching" of the paper sheet from the centre to the outer edges, blade 1 being positioned almost at the longitudinal axis of paper band N.

Upper bars BS1 and BS2 also support devices 30A and 30B, respectively, which guide and promote the first fold to be formed in the paper band by the set of blades 1 to 9.

Only device 30B supported by rod BS2 will be described as the drive means of device 30A has been omitted in FIG. 2 for the sake of evidence.

Device 30B consists of a V-shaped member 31 of suitable dimension which is supported by a rod 32 hinged at 33 on two tongues integral with rod BS2. Rod 32 is urged outwards by springs 34 mounted between upper end 35 thereof and a bracket 36 integral with rod BS2. Rod 32 is operated by cam 37 which is synchronized with the rotation of blade carrier shaft 10B by means of cog belt and pulley drive designated by 38–39 which is part of device 40B. When shaft 10B rotates cam 36 urges rod 32 as well as V-shaped member 31 placed near blade 1*c* to come into contact with the upper edge of pile PC. In other words V-shaped member 31 moves alternately and synchronously with blade 1 in order to always position the natural fold CRN of the paper band correctly with respect to blade carrier shaft, thus causing cross-perforations PNC of paper band, at which the folding of paper has to be carried out, to be suitably positioned to start the paper squeezing. This results in an improvement of the whole assembly operation at high speed.

Once blade 1 starts to squeeze the paper the V-shaped member, which is not urged any longer by cam 36 against rod 32, is moved by spring 34 away from the edge of the pile.

In FIG. 2 blade 1 of left-hand shaft 10B is shown when the natural fold of paper CRN is beinq squeezed, and at the opposite side of pile PC which is being formed squeezing blade 1*c* to 9*c* of shaft 10A are operated to squeeze the formed fold.

FIG. 5 shows the way to squeeze the "natural fold" of paper CRN along cross perforations PNC by means of the apparatus of the invention. In this schematic representation movement of blades with respect to pile PC is indicated by arrows 25; left and right hand blades 1 and 2, respectively only the ends of which are shown for the sake of evidence, are already tightly engaged with paper, thus squeezing the paper blades 3 are in an intermediate step of squeezing; blades 4 have just started to squeeze paper; blades 5 have not engaged paper yet and blades 6, 7, 8 and 9 are even more remote from paper pile.

With such a construction the folding head operates as follows:

Tractor feed TRC causes paper band N to be unrolled from the reel (not shown) and a suitably operated distributor DST supplies paper band between the two cages GLl, GL2, thus causing it to form loops as shown at CRN in FIG. 2.

Rotation of both shafts 10A and 10B is synchronized with operation of devices 30A and 30B by known means, thus causing natural folds CRN to be formed at the cages GLl and GL2, respectively, in the angular sector between the two sets of blades 1 to 9 and 1*c* to 9*c*. Furthermore, since as mentioned movement of devices 30A and 30B is synchronized with rotation of shafts lOA and 10B, respectively, before blades 1 to 9 engage fold CRN, the latter is engaged by V-shaped member 31 as rod 32 thereof is urged inwards by cam 37.

Therefore blades 1 and all pairs of blades 2 to 9 will engage in succession the folded sheet retained by V-shaped member 31 and will cause a first compression of the fold as above mentioned from the centre to the edges.

Then, when V-shaped member 31 moves away from the folded sheet, and shaft 10B keeps on with its rotation, blades lc to 9*c* of the second set will engage the formed fold and will squeeze it. To this end blades of the second set can have a stronger stiffness than those of the first set.

It should be understood that both shafts 10A and 10B will be offset by such an angle to synchronize their operation with the forming of loops made alternately by the combined action of gravity and distributor DST at side cages GL1 and GL2, and the speed of rotation of said shafts is adjusted according to the speed with which paper band N is folded like an "accordion" on the moving support plate PSM.

As far as the format of the paper sheets forming the pile is concerned, it is possible, as already known from the status of art, to vary the distance between cages GL1 and GL2, as provided on the other hand by the known folding heads, by easy already known modifications of the drive means of blade carrier shafts 10A and 10B.

Of course it is further needed a synchronism between the speed at which the paper sheets pile up and the speed of descent of the moving support plate, since the upper surface of the pile must be steadily positioned at the height of the blades of both blade carrier shafts 10A and 10B.

It should be understood from what set forth that the invention provides an easy, reliable and cheap apparatus solving the problem of automatically and oerfectly carrying out cross-foldings needed to form piles of sheets having a given format from a continuous paper band.

I claim:

1. In a continuous paper band folding apparatus to form piles of paper sheets from a paper band supplied from a storage reel and provided with tearing cross perforations, said apparatus comprising: a moving paper supporting plate on which the paper band is folded like an "accordion" by the action of gravity and a distributor of the known type; a paper band tractor feed system and two side cages retaining the paper pile to be formed and defining the dimension thereof; a device for folding the paper band at each crossperforation which is provided with two folding members, one on each side of the pile, said members folding the paper band in two distinct steps consisting of a first step of folding and a second step of compressing the paper band, and two devices, one for each folding member, guiding the paper band and causing it to keep on the natural fold at the beginning of said first step, characterized in that each folding member is provided with two sets of means acting on the paper band so that the folding action begins at the center thereof, i.e. at the longitudinal axis of the paper band, and carries on symmetrically from said center to the outer edges of the paper band.

2. The apparatus of claim 1, wherein said folding members are supported each by one of said side cages.

3. The apparatus of claim 1, wherein each device guiding the paper band and causing it to keep on the natural fold is provided with a V-shaped member supported by a rod which is hinged on the respective cage, a spring urging the rod to move away from said cage, and cam means operated by the respective blade carrier shaft and urging said rod to said cage and to the paper sheet pile to be formed.

4. The apparatus of claim 1, wherein each folding member comprises a rotating shaft carrying two sets of not rigid blades in an odd number, the blades of each set being radially arranged with one blade in a central position and the other blades arranged symmetrically along said shaft on either side of the central blade so that the blades at the same distance from the central blade form a pair lying on the same radial plane, and each radial plane containing the blades of a pair is offset by an angle both to the radial plane containing the preceding pair of blades and the radial plane containing the following pair of blades.

5. The apparatus of claim 4, wherein the blades of either set having the same arrangement on the shaft are diametrally opposed to each other.

6. The apparatus of claim 4, wherein the offset angles between the radial planes containing said pairs of blades are such that there is a wide angular space between the outermost pair of blades of one set and the central blade of the radially opposed set of blades, and the central blade of each set is always the first blade of the set engaging the paper band to be folded.

7. The apparatus of claim 4 wherein both rotating shafts of the folding members are rotated synchronously by a motor means.

* * * * *